United States Patent [19]

Clark

[11] 3,939,507

[45] Feb. 24, 1976

[54] WATER CLOSET WATER VOLUME CONTROL

[76] Inventor: Edward C. Clark, 8840 4th St. N., St. Petersburg, Fla. 33702

[22] Filed: July 1, 1974

[21] Appl. No.: 484,614

[52] U.S. Cl. ..... 4/67 A; 4/34

[51] Int. Cl.[2] .. A61B 19/00; E03D 1/34; E03D 5/02

[58] Field of Search ..... 4/67 A, 18, 67 R, 57 R, 4/57 P, 34, 37, 201, 206

[56] References Cited

UNITED STATES PATENTS

| | | | |
|---|---|---|---|
| 2,760,206 | 8/1956 | Loyd | 4/57 R |
| 2,904,794 | 9/1959 | Goldtrap | 4/57 R |
| 2,970,319 | 2/1961 | Lassiter | 4/57 P |
| 3,049,721 | 8/1962 | Taylor | 4/37 |
| 3,167,787 | 2/1965 | Conneoly | 4/57 P X |
| 3,282,288 | 11/1966 | Sheppard | 4/57 R X |
| 3,731,324 | 5/1973 | Moon | 4/18 |
| 3,732,577 | 5/1973 | Moon | 4/18 |
| 3,758,893 | 9/1973 | Smolinski | 4/67 A |
| 3,831,204 | 8/1974 | Cook | 4/57 R |
| 3,839,747 | 10/1974 | Clark | 4/67 A |

*Primary Examiner*—Henry K. Artis
*Attorney, Agent, or Firm*—Robert F. Ruemeli

[57] ABSTRACT

A water closet is provided with a device for limiting the amount of water discharged from its water tank during flushing. More particularly, the volume of water discharged from the tank is limited by low water level reached during flushing. The water limiting device has a tube inserted into the outlet water passage of the tank and through the normal valve seat of the typical ball or flapper valve member, and the valve member is seated atop the tube. In one embodiment, for use with an outlet valve unit having a generally horizontal valve seat, the bottom of the tube is tapered to wedge into telescopic relationship with the outlet passage and may, if desired, be fixedly secured to the normal overflow pipe of the outlet valve unit. In a unit having an inclined seat for receiving a flapper valve member, the tube has a cylindrical end portion telescoped into the outlet passage, and an inclined flange seated against the inclined valve seat. Below this flange is an annular seat which mates with a beveled mouth of the outlet passage. The tube seat may be resilient and sealingly engage the mouth with an integral annular gasket seated against the flange and the valve seat. An arm integral with the upper portion of the tube is secured to the overflow pipe and carries a pair of opposed fingers for receiving apertured ears of the flapper valve which is seated atop the tube. These fingers are comparable to the conventional fingers provided on the typical outlet valve unit. A variation has a rigid tube seat integral with the flange, for seating against the beveled mouth of the outlet passage, and a separate annular gasket is provided for seating between the flange and the valve seat of the outlet passage.

27 Claims, 4 Drawing Figures

WATER CLOSET WATER VOLUME CONTROL

This invention relates to a water closet and, more particularly, to reducing the quantity of flushing water, and to a device which may be applied to the tank for reducing the amount of flushing water.

BACKGROUND OF THE INVENTION

Various expedients have been suggested for reducing the quantity of flushing water discharged during flushing of a water closet. For example, bricks or similar objects may be deposited in the water tank, if space permits without interfering with the mechanisms within the tank. It has also been suggested to provide a dam about the outlet valve of the water tank, so that the quantity of water outside of the dam will be retained in the tank. A common problem with such dams as shown for example in U.S. Pat. Nos. 3,259,918, and 3,731,324, is that of securing and sealing the dam within the water tank. Other United States patents known to applicant include:

815,661
2,065,347
2,884,650
2,944,265

It is, therefore, a primary object of this invention to provide a new and useful water closet with provision for limiting the amount of water discharged during each flushing of the water closet. A related object is provision in such a water closet of a tube inserted into the normal water outlet passage of the water tank, the tube having a valve seat on its upper end for receiving the typical outlet valve member of the water tank. Another related object is provision for sealing the connection between the tube and the water passage.

Another object is provision of a new and useful device for increasing the minimum water level in a water tank of a water closet, thereby reducing the volume of water discharged from the tank during flushing of the water closet. A related object is provision of such a device in the form of a water level limiting unit including a tube connected with the outlet water passage of the tank and having a valve seat at its upper end for receiving the typical outlet water valve member of the water closet. In one embodiment the tube is seated about a generally horizontal valve seat for the outlet valve member, and in another embodiment, about an outlet valve unit having an inclined seat for the valve member. In the latter embodiment an upper portion of the tube is provided with an arm which is fixedly secured to the usual overflow pipe of the outlet valve unit, the arm carrying fingers for receiving apertured ears of the valve member to secure the valve member in position for seating on the upper open end of the tube.

By varying the heigth of the tube above the conventional valve seat of the outlet valve unit, the quantity of water discharged from the tank may be increased or decreased. Depending on the local area in which the water level limiting unit is to be used, it may be desirable to assure a minimum quantity of flushing water over that which is necessary to adequately flush the water closet commode or urinal bowl, in order to provide adequate water for carrying the refuge through the sewer lines, and a water volume of approximately two and one half gallons has been found to be adequate. This is considerable reduction in the water volume normally provided in the amount of five to six gallons, and thus considerable water is conserved. Similarly, the amount of sewage to be treated is reduced.

These and other objects and advantages of the invention will be apparent from the following description and the accompanying drawings.

DESCRIPTION OF THE ILLUSTRATED EMBODIMENTS

Figure 1:
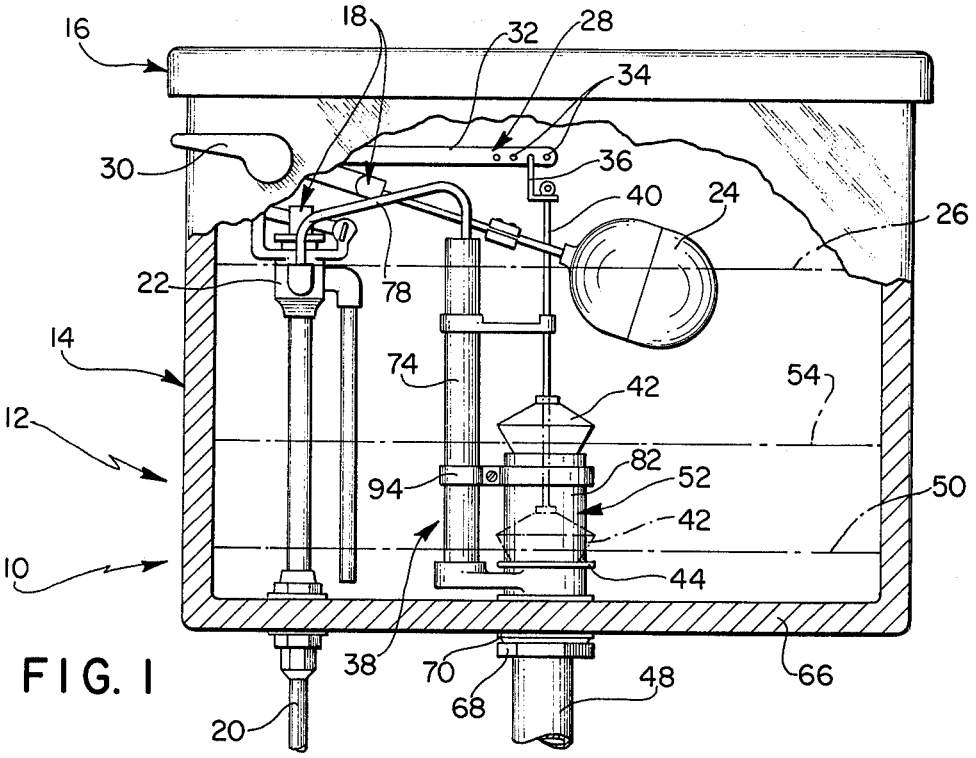
FIG. 1 is a schematic fragmentary, front elevational view of a portion of a water closet showing a flushing water tank with a portion of its front wall broken away and removed for clearer illustration, and with a water limiting unit with a typical ball outlet valve member.

Referring to FIG. 1 of the drawings, a water closet 10 includes a flushing water tank 12 having a typical tank body 14 with a lid 16 seated atop the open upper end of the tank body 14. A typical water inlet assembly 18 is connected with a water supply line 20 and has an inlet valve 22 operated by a typical float 24 for maintaining a normal water level 26 within the tank body 14. A typical water discharge actuator assembly 28 includes a manually operable actuator 30 connected with an arm 32 having a plurality of holes, as 34, along its free end for adjustably receiving a link 36 connected with an outlet valve unit 38 and, more particularly, with a rod 40 secured to a typical ball valve member 42 of the outlet valve unit 38. As shown in phantom lines, in normal or conventional assembly of the outlet valve unit 38, the ball valve member 42 is received in closed position on an annular valve seat of 44 at the mouth of the passage 46 (FIG. 2) communicating in typical manner with a flushing water pipe 48 to a typical commode, urinal (not shown) or the like, of the water closet 10. In normal assembly of the outlet valve unit 38, a minimum water level 50 (phantom line) is normally in the tank body 14 during flushing of the water closet 10. In order to reduce the quantity of water discharged during each flushing of the water closet 10 a water limiting unit 52 is provided so that a higher minimum water level 54 results during flushing of the water closet 10, thus saving a considerable quantity of water, as will be more fully described.

Figure 2:
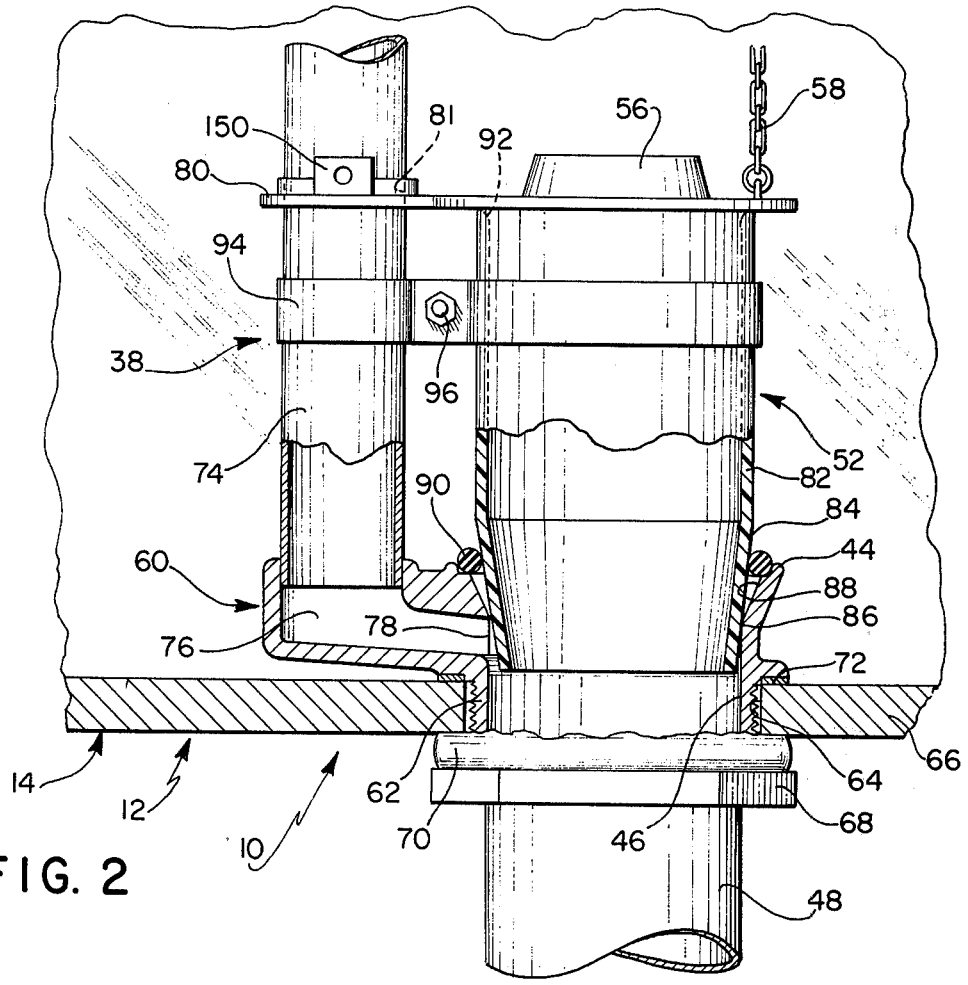
FIG. 2 is an enlarged, schematic fragmentary, front elevational view of a portion of the water closet shown in FIG. 1, with parts broken away and removed for clearer illustration, and showing the water limiting unit with a typical flapper valve member in lieu of the ball valve member shown in FIG. 1.

With reference to FIG. 2, a typical flapper valve member 56 is illustrated in lieu of the ball valve member 42 shown in FIG. 1. The flapper valve member 56 is typically provided with a chain 58, or the like, connected with the actuator arm 28 (FIG. 1) in lieu of the rod 40 of the ball valve member. Ball and flapper valve members are generally interchangeable in valve units of this type. The outlet valve unit 38 has a rigid base 60 with a depending threaded nipple 62 received in a hole 64 in the bottom wall 66 of the tank base 14, and is secured in place by a nut 68 threaded onto the nipple 62 and tightly seated against a gasket 70 abutting the lower face of the wall 66 with an inner gasket 72 between the base 60 and the inner face of the wall. The outlet passage 46 extends through the nipple 62 and is secured in typical manner to the outlet pipe 48. The outlet valve unit 38 includes the typical overflow pipe 74 opening into a passage 76 in the base 60, this passage terminating in a port 78 opening into the outlet passage 46 of the base 60. In addition to limiting the maximum water level 26 in the tank 12, the open upper end of the overflow pipe 74 receives the typical filler pipe 78 (FIG. 1) from the water inlet assembly 18, for filling the bowl of the commode or urinal after flushing thereof.

As illustrated in FIG. 2, the flexible flapper valve 56 has an attaching portion 80 with an aperture 81 telescoped over the overflow pipe 74 and snugly engaging the pipe to retain the flapper valve in place, whether it be seated on the valve seat 44 of the outlet valve unit base 60, or atop the water limiting unit 52 (as shown).

The water limiting unit 52 includes a body in the form of a conduit and more particularly a rigid tube 82 having a lower, annular end portion 84 downwardly tapered and telescopically wedged against a shoulder 86 of the outlet passage 46, the shoulder being formed by the juncture of a generally cylindrical lower portion of the outlet passage 46 and beveled or frusto-conical mouth 88 thereof. This mouth 88 terminates in the valve seat 44 of the base 60. While exagerated for clearer illustration in FIG. 2, the tapered lower end portion 84 may have a very small taper of approximately three degrees with the axis of the tube 82. A suitable resilient sealing member, such as an O-ring 90 may be of any suitable cross sectional configuration such as square, or as illustrated circular, and is of a diameter to tightly grip the tapered end portion 84 of the tube 82 and to be wedged between the inner face of the valve seat 44 and the tube end portion 84 to seal the opening therebetween. The upper end portion of the tube 82 is provided with a valve seat 92 for receiving the outlet valve member 56, or 42 in FIG. 1. The seat 92 is preferably internally beveled or rounded.

In order to securely retain the water limiting unit 52 in operative assembly with the outlet valve unit 38, the tube 82 is rigidly secured to the overflow pipe 74 in any suitable manner, as by a band 94 about the tube 82 and the pipe 74, and therebetween clamped together as by a nut and bolt 96. Alternatively, the tube 82 may be rigidly secured to the overflow pipe 74, as by an integral connector to be described with reference to the modification of FIG. 3.

The water limiting unit 52 may be made of any suitable material such as Polyvinylchloride, Type 1 Grade 1, or CPVC (chlorinated polyvinylchloride Type 4, Grade 1), or aluminum or copper, which may be spun, cast or otherwise fabricated, for example.

Figure 3:
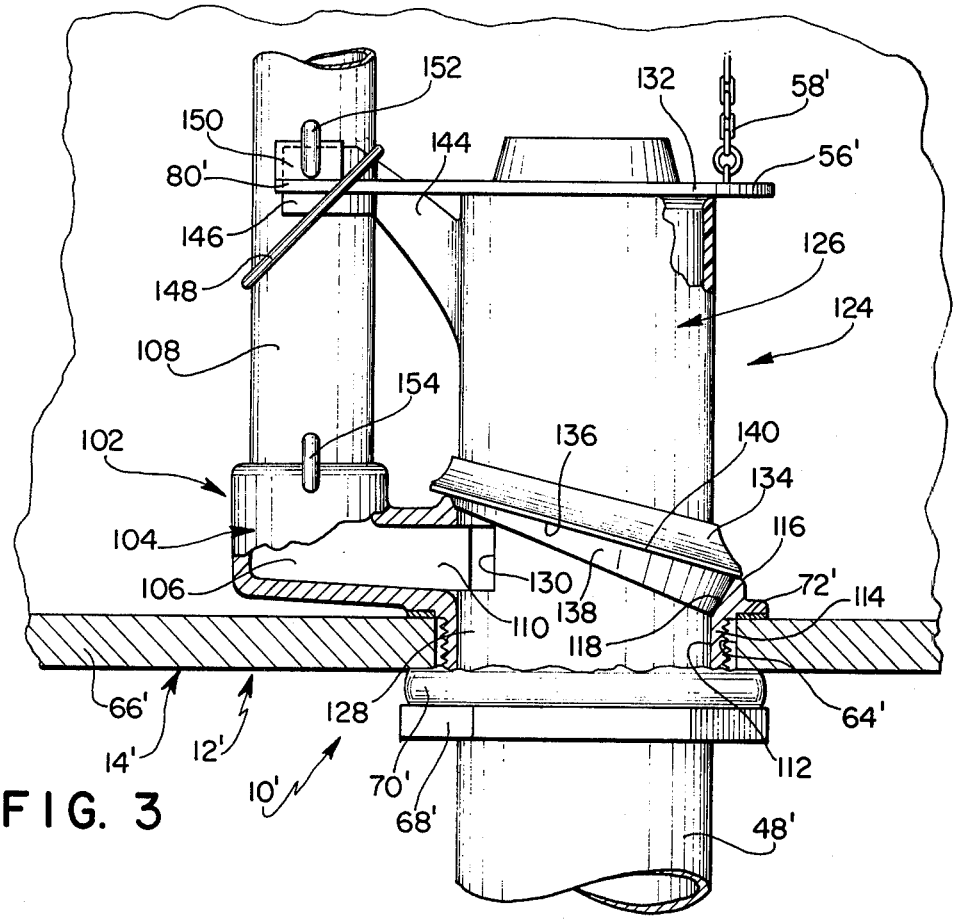
FIG. 3 is a schematic fragmentary, front elevational view similar to FIG. 2, but showing a modified form of the outlet valve unit and water limiting unit, with parts broken away and removed for clearer illustration.

Referring to FIG. 3, reference numerals primed, as 64′, designate identical or similar parts as those parts indicated by the unprimed reference numerals in FIGS. 1 and 2, and these parts will not necessarily be described again. Outlet valve unit 102 has a base 104 with an outlet passage 106 receiving an overflow pipe 108 and terminating in a port 110 opening into an outlet passage 112 in a depending nipple 114 which extends through the hole hold 64′ of the tank base 14′, and is secured in place by a nut 68′ with gaskets 70′ and 72′, as previously described. In this modification of the outlet valve unit 102, a valve seat 116 for receiving a flapper valve member 56′, is inclined downwardly away from the overflow pipe 108, and the valve seat is generally rounded as in the prior embodiment. From the valve seat 116 a downwardly converging annular mouth 118 terminates in the outlet passage 112 which in turn is connected with an outlet pipe 48′. Because of the inclination of the valve seat 116, the mouth 118 is shallower adjacent the overflow pipe 108 than at the portion remote from this pipe, as illustrated in FIG. 3.

In FIG. 3, the water limiting unit 124 has a cylindrical tube 126 with a lower cylindrical portion 128 telescopically seated in the outlet passage 112 and having a port 130 aligned with port 110 of the outlet valve unit, for passage of overflow water and bowl filling water through the overflow pipe 108 and into the outlet passage 112 which is connected with the outlet pipe 48′. The upper end portion of the tube 126 has a valve seat 132 which is preferably internally rounded or beveled to provide a seat for the flapper valve member 56′. In the illustrated embodiment, a flange 134 has a lower face 136 inclined to the axis of the tube 126 to a degree such that the lower face 136 may seat on the valve seat 116 of the outlet valve unit 102 when the tube 126 is inserted into the outlet passage 112. The flange 134 is preferably rigid and may be formed integrally with the tube 126, as during casting thereof, or may be a separate unit adhesively secured or soldered to the tube 126 depending upon the material and method of fabrication of the water limiting unit 124. In this embodiment, a resilient sealing unit 138 is positioned directly below and in abutting engagement with the flange 134, and is configured to conform to the annular configuration of the mouth 118 of the outlet valve unit 102. An outwardly extending flange 140 is preferably formed integrally with the resilient seat 138 and defines a shoulder which abutts the lower face 136 of the rigid flange 134, and is tightly seated against valve seat 116 so that in combination the resilient seat 138 and the resilient flange 140 form a tight seal between the tube 126 and the outlet passage 112.

The resilient seat 138 may have an interior diameter such as to tightly resiliently engage the tube 126, or it may be adhesively secured to the tube, depending on the materials utilized in manufacture of the unit 124.

In order to retain the water limiting unit 124 in position on the outlet valve unit 102 and to retain the flapper valve 56′ in place, an arm 144 is integral with the tube 126 and at its free end has a resilient yoke 146 which snaps about the overflow pipe 108 and, if desired, a resilient band 148 may be provided (as shown) for further retaining the water limiting unit 124 in place. As applied in this embodiment, the flapper valve member 56′ has an attaching portion 80′ with a pair of opposed apertured ears 150 (only one ear being visible in FIG. 3), the apertures being received over fingers 152 of generally L-shape with their base secured to the opposite portions of the yoke 146, to retain the flapper valve member 56′ in place. These fingers 152 conform to fingers 154 on the standard outlet valve unit 102 for receiving the apertured ears 150 during normal assembly of the outlet valve unit with the flapper valve member 56′ seated on the valve seat 116.

With the exception of the resilient seat 138, the water limiting unit 124 may be made of any suitable material, such as that previously described with reference to the embodiment of FIGS. 1 and 2.

Figure 4:
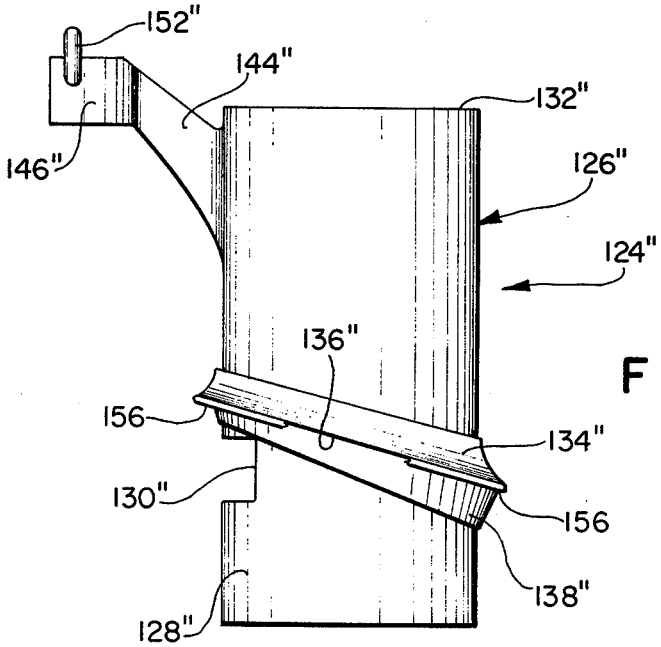
FIG. 4 is a schematic, front elevational view of a modification of the water limiting unit of FIG. 3, but removed from the outlet valve unit.

With reference to the modification of FIG. 4, reference numerals double primed, as 124″, indicate similar or identical parts as those indicated by the unprimed reference numerals in FIG. 3 and these parts will not necessarilly be again described. This embodiment differs from the embodiment of FIG. 3 only to the extent that the seat 138'' which engages the mouth 118 of the outlet passage 112 (FIG. 3) is of a relative rigid material such as that of the flange 134'' and is preferably formed integrally with this flange. A separable resilient annular gasket 156 is telescoped onto the seat 138'' and against the lower face 136'' of the flange 134''. This gasket 156 defines a shoulder which is seated against the valve seat 116 (FIG. 3) to provide a tight seal between the water limiting unit 124' and the outlet passage 112.

It should be noted that the flapper valve members 56 (FIG. 2) and 56' (FIG. 3) are generally identical in replacement valve members, the apertured portion 80 in FIG. 2 being severed from the apertured ears 150 when the ears are connected with the fingers 152 in FIG. 3.

While this invention has been described with reference to various embodiments in a particular environment, various changes may be apparant to one skilled in the art, and the invention is therefore not to be limited to such embodiments or environment except as set forth in the apended claims.

What is claimed is:

1. A water closet comprising, a flushing water tank including an outlet valve unit having an outlet passage with a valve seat, said unit further having a valve member operatively associated with said valve seat in conventional assembly of the outlet valve unit for controlling the flow of flushing water from the tank through the outlet passage, and a device including a conduit operatively fixed to a fixed portion of said outlet valve unit and having one end portion in substantially fixed sealed telescoped engagement with said outlet passage, and an opposite end portion having a valve seat spaced upwardly from the first said valve seat, and said valve member being operatively associated with the conduit valve seat for controlling the flow of flushing water from the tank through the conduit and the outlet passage, thereby reducing the quantity of flushing water discharged from the tank over the quantity discharged when the outlet valve unit is in said conventional assembly.

2. A water closet as set forth in claim 1 in which said one end portion of the conduit is tapered and is received in said outlet passage in wedging engagement with said unit.

3. A water closet as set forth in claim 1 in which said one end portion of the conduit is telescoped into said outlet passage, and a shoulder on said conduit and in abutting engagement with the first said valve seat.

4. A water closet as set forth in claim 1 in which the device includes sealing means between the conduit and the outlet passage.

5. A water closet as set forth in claim 1 in which said unit includes an overflow pipe, and said conduit is secured to said pipe, to operatively fix the conduit to the unit.

6. A water closet as set forth in claim 1 in which said unit has an overflow pipe communicating with a discharge port opening into said outlet passage, said one end portion of the conduit is tapered and is telescoped into said outlet passage in wedging engagement with said unit, and the tapered end portion of the conduit overlying and spaced from the port for flow of water from the port into the outlet passage.

7. A water closet as set forth in claim 6 in which a portion of said conduit above the tapered end portion is rigidly secured to said overflow pipe, and an O-ring seal between the conduit and the outlet passage preventing passage of water from the tank about the conduit and into the outlet passage.

8. A water closet as set forth in claim 1 in which said one end portion of the conduit is telescoped into said outlet passage, and a mounting portion on said conduit includes a shoulder seated on the first said valve seat.

9. A water closet as set forth in claim 8 in which the shoulder includes a sealing gasket between the shoulder and the first said valve seat.

10. A water closet as set forth in claim 9 in which said outlet passage has a mouth diverging toward the first said valve seat, and said mounting portion includes a seat complementary to said mouth and seated thereon.

11. A water closet as set forth in claim 10 in which a securing portion of the conduit above the shoulder is operatively fixed to a fixed overflow pipe of the unit.

12. A water closet as set forth in claim 10 in which the complementary seat is yieldably and sealingly engages the mouth.

13. A water closet as set forth in claim 12 in which the outlet valve unit has an overflow pipe communicating with a discharge port opening into said outlet passage and additionally has opposed fingers for receiving the valve member in said conventional assembly thereof, the securing portion of the conduit carries similar fingers for receiving the valve member and positioning the valve member on the conduit valve seat, the complementary seat and gasket are annular and integral with each other, and the conduit is a relatively rigid cylindrical tube and has a port aligned with the first said port for passage of water from the overflow pipe through the ports into the outlet passage.

14. A water closet as set forth in claim 10 in which the complementary seat is substantially rigid.

15. A water closet as set forth in claim 14 in which the outlet valve unit has an overflow pipe communicating with a discharge port opening into said outlet passage and additionally has opposed fingers for receiving the valve member in said conventional assembly, the securing portion of the conduit carries similar fingers for receiving the valve member and positioning the valve member on the conduit valve seat, the conduit is a substantially rigid tube and the complementary seat and shoulder are annular and integral with each other and with the tube, and the tube has a port aligned with the first said port for passage of water from the overflow pipe through the ports and into the outlet passage.

16. A water closet flushing tank water level control device comprising an elongated conduit having opposite ends, a first of said ends including means for operatively fixedly sealed connection with a typical outlet water passage of the tank, and the other of said ends having means in the form of a valve seat for receiving a typical outlet valve member of the tank, and means on said conduit for maintaining the first end in said fixedly sealed connection with said outlet water passage and for operatively fixedly securing said conduit relative to a fixed portion of said tank, whereby the device appreciably reduces the quantity of water discharged from the tank.

17. A device as set forth in claim 16 in which the connection means comprises a tapered outer surface of the conduit.

18. A device as set forth in claim 17 in which the conduit is a cylindrical tube, the valve seat is annular and is inwardly convergent, and means for connecting the tube with an overflow pipe of the tank.

19. A device as set forth in claim 16 in which the connection means comprises a shoulder about said conduit.

20. A device as set forth in claim 19 in which the connection means further comprises a continuous seat about said conduit and converging away from said shoulder.

21. A device as set forth in claim 20 in which said shoulder is continuous about said conduit and adjacent the continuous seat, and a sealing gasket on said shoulder.

22. A device as set forth in claim 21 in which the conduit is a relatively rigid cylindrical tube, said shoulder and said continuous seat are relatively rigid and are secured to the tube, said gasket is relatively yieldable, and means for connecting said tube with an overflow pipe of said tank.

23. A device as set forth in claim 22 in which the connecting means includes fingers for mounting the valve member to seat on said valve seat.

24. A device as set forth in claim 21 in which said continuous seat is yieldable for sealing engagement with said passage.

25. A device as set forth in claim 24 in which said conduit is a relatively rigid cylindrical tube, and said shoulder is relatively rigid and is secured to said tube.

26. A device as set forth in claim 25 in which said gasket is integral with said continuous seat, said shoulder is continuous about said conduit and adjacent the continuous seat, and a sealing gasket on said shoulder.

27. A device as set forth in claim 26 in which the connecting means includes fingers for mounting the valve member to seat on said valve seat.

* * * * *